United States Patent [19]

Juty

[11] Patent Number: 4,572,398

[45] Date of Patent: Feb. 25, 1986

[54] CLOSURES FOR CONTAINERS

[75] Inventor: Andrzej J. J. Juty, Kenton, England

[73] Assignee: Metal Box p.l.c., Reading, England

[21] Appl. No.: 714,825

[22] Filed: Mar. 22, 1985

[30] Foreign Application Priority Data

May 8, 1984 [GB] United Kingdom ..... 8411620

[51] Int. Cl.[4] ..... B65D 17/34

[52] U.S. Cl. ..... 220/271; 220/307

[58] Field of Search ..... 220/270, 271, 307

[56] References Cited

U.S. PATENT DOCUMENTS

| | | | |
|---|---|---|---|
| 3,756,448 | 9/1973 | Moller et al. | 220/271 |
| 4,344,545 | 8/1982 | Aschberger et al. | 220/307 |
| 4,431,110 | 2/1984 | Roth | 220/270 |

*Primary Examiner*—George T. Hall

*Attorney, Agent, or Firm*—Diller, Ramik & Wight

[57] ABSTRACT

A tear open plastics closure for a can end having a pouring aperture and a venting aperture comprises respective annular collar portions fitting in an airtight manner in the apertures and plugs rupturably sealed over the mouths of the collars and capable of being forced back into the collars to re-seal the apertures, the plugs being connected together by a connecting member which is flexibly connected (e.g. by a step piece and a yoke) to one of the collar portions. The connections between each collar portion and the other parts of the closure ensure that the collar portions can tilt and move laterally relative to one another. For example, the collar portions may have no direct connection with one another but be attached solely to the plugs and by the flexible connection of one collar portion to the connecting member. Alternatively they may be connected by a narrow flexible bridge.

9 Claims, 15 Drawing Figures

CLOSURES FOR CONTAINERS

BACKGROUND OF THE INVENTION

1. Field of the invention

This invention relates to tear open closures for containers of the kind which have a pouring aperture and a venting aperture in one end of the container, and more particularly but not exclusively to tear open closures of plastics material for fitting into can ends suitable for seaming to can bodies containing a carbonated beverage.

2. Description of the Prior Art

British Patent Specification No. 1,389,351 describes a can of this kind provided with an opening device moulded from a plastics material so as to have a resilient aperture or lip portion defining a pouring aperture and a smaller venting aperture aligned with the container openings, the lip portion being airtightly connected to the can end; a resilient removable portion connected to the lip portion by a hinge between adjacent ends of said portions, the removable portion carrying plugs on its undersurface which are attached in an airtight but rupturable manner to the edges of the apertures in the lip portion; and a pull tab normally located adjacent the hinge and connected to said removable portion by two legs which encircle the removable portion and are connected to its further or outer end, adjacent the periphery of the can end. In order to open the device the user lifts the pull tab and the legs transmit the force exerted on the pull tab to the outer end of the removable portion so as to rupture the plugs from the pouring aperture and the vent aperture in turn. Continued pulling thus opens the pouring aperture and then the vent aperture and the hinge allows the removable portion to be extended away from the apertures to facilitate drinking or pouring, while keeping it attached ready for reclosure by fitting the plugs on the removable portion into the apertures.

The closure disclosed in British Patent Specification No. 1,389,351 thus consists of the aperture or lip portion, which includes two annular collar portions fitting tightly in the apertures, and, above the aperture portion, the removable portion which is connected to the aperture portion by the joints between the plugs and the collars and by the hinge.

The arrangement of the upper removable portion, the lower or aperture portion and the plug to collar joints gives rise to a plastics moulding which has rectilinear rigidity, like that of a box section, so that the collar portions are unable to tilt readily in relation to one another, as is necessary when the closure is to be fitted into a domed can end or when the can end is liable to assume a domed shape under internal pressure in the can. In such cases it is essential that the closure shall bend so that the axis of one collar is inclined to the axis of the other collar, so enabling each collar to fit correctly within the respective aperture in the domed can end panel. The rigid arrangement also means that the collar portions are unable to yield to accommodate any dimensional difference between the distance between the centres of the apertures in the can end and the distance between the centres of the collar portions. Whilst the apertures in the sheet metal of the can end are dimensionally stable, it is in the nature of plastics materials to exhibit some variation in shrinkage during setting after moulding, so that it is desirable to provide some degree of lateral float or flexibility for the collar portions with respect to one another in order to facilitate fitting of the collars into the can end.

Plastics materials as used for the closure have a degree of inherent flexibility, but it is not practicable to use a very flexible material because the collar portions would then tend to slip out of the apertures. Experience has shown that, when the closures are fitted into domed can ends or can ends which assume a domed shape under internal pressure, or when dimensional variations occur in the closures, the rigidity conferred by the arrangement referred to above results in stresses on the collar portions and consequent distortion giving rise to leakage.

SUMMARY OF THE INVENTION

Accordingly this invention provides a closure, for a container of the kind having a pouring aperture and a venting aperture in one end of the container, said closure being moulded in one piece of plastics material and comprising respective annular collar portions adapted to be fitted in an airtight manner within the said apertures, and respective plugs each attached by a rupturable section of the plastics material to the mouth of its annular collar portion to seal the respective aperture each plug being shaped so that after breaking of the rupturable section to open the aperture the plug can be forced back into the collar portion to re-seal the aperture, the two plugs being connected to one another by a connecting member which is flexibly connected to one of the collar portions so as to retain the plugs after opening of the apertures, characterised in that the connections between each collar portion and the other parts of the closure are such as to ensure freedom of the collar portions to tilt relative to one another.

Preferably the connections between each collar portion and the other parts of the closure consist solely of the rupturable attachments of the plugs and the flexible connection of the said one collar portion to the connecting member. By thus eliminating direct connections between the collar portions, the latter can be given a considerable degree of freedom to tilt and to move laterally in relation to one another.

In a first embodiment, the said flexible connection is provided by a flexible yoke attached to the said one collar portion and a step piece which joins the yoke to the connecting member. The connecting member may comprise a pair of straps which connect remote sides of the two plugs together to allow relative tilting movement of the plugs.

In a second embodiment the said flexible connection comprises a pair of straps, each strap extending from the connecting member adjacent to the pouring aperture plug past one side of the vent plug to a fold and back past one side of the venting aperture collar portion to the pouring aperture collar portion. Unfolding of the folded straps permits the plugs to be pulled clear of the collar portions after opening of the apertures, to permit pouring or drinking.

In some cases, a direct connection between the collar portions can be used, provided that it is sufficiently flexible and that the connecting member between the plugs is also flexible.

Thus, in a third type of embodiment, the collar portions are attached to one another by a narrow flexible bridge and the connecting member comprises a pair of straps which connect one plug to the remote side of the other plug. The narrow bridge permits some elastic relative movement between the collar portions and permits any necessary tilt of the axis of the collars. In these embodiments, the flexible connection of the said one collar portion to the connecting member may be provided by a step piece joining the bridge to the connecting member. The step piece serves as a hinge to permit swinging of the pouring aperture plug clear of its collar portion for pouring.

In any of the embodiments, a pull ring is preferably connected directly with the vent plug. The pull ring may surround the vent plug and the pouring aperture plug, before it is lifted to tear open the closure, this arrangement resulting in a large ring which is easier to grip.

All the embodiments permit opening by tearing the plugs away from the collar portions. In all examples the plugs are held captive on a collar portion after opening and remain available for use as snap fit reclosures in the collars.

DETAILED DESCRIPTION OF THE INVENTION

Figure 1:
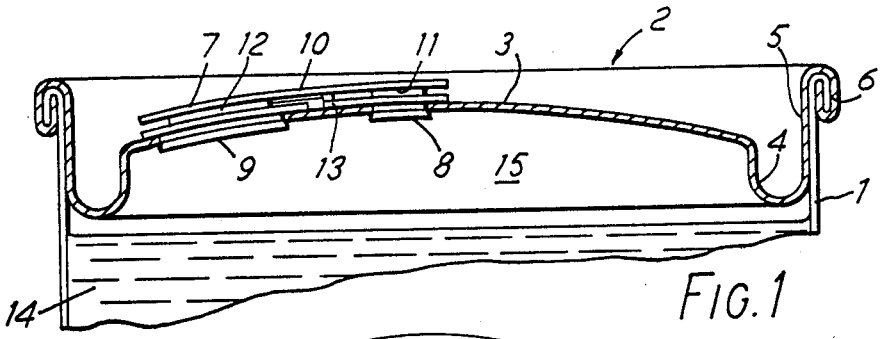
FIG. 1 is a section through the top part of a can filled with carbonated beverage and closed by a closure according to the invention.

FIG. 1 shows a can body 1 closed by a can end 2 comprising a domed central panel 3 surrounded by a bead 4 connected by a chuck wall 5 to a double seam 6 which attaches the can end 2 to the body 1.

There are two apertures in the central panel 3, namely a smaller vent aperture near the centre of the domed central panel 3 and a larger pouring aperture nearer the bead 4.

The apertures are closed by a closure 7 moulded from a plastics material such as polypropylene or high density polyethylene (such as grade No. GB 6450 from HOECHST).

The closure 7 comprises a first collar portion 8 fitted in an airtight manner into the vent aperture and a second collar portion 9 fitted in an airtight manner into the pouring aperture. A flexible connecting member 10 connects a vent plug 11 (sealed to the vent aperture collar portion 8) to a pouring aperture plug 12 (sealed to the pouring aperture collar portion 9). The flexibility of connecting member 10 permits each collar portion to tilt, if necessary, to enter its respective aperture and achieve a good flat engagement with the domed panel 3. The connecting member 10 is shaped to permit some elastic extension to permit any necessary lateral relative movement between the collars to achieve an easy fit of the collars in the apertures in the panel.

The connecting member 10 is flexibly connected at 13, e.g. as described below with reference to FIG. 2, to the vent collar portion 8 so that when the plugs 11, 12 are torn from their collars 8, 9 the plugs are retained captive on the can end 2. The opened plugs may be used to reclose the collars.

In FIG. 1 the can body 1 is shown to be filled with a carbonated beverage 14 so that internal pressure in the headspace 15 causes the central panel 3 to bulge into domed form. Any increase in this headspace pressure will cause distention of the profile of the central panel. As the connecting member 10 is flexible, any distorting forces arising from relative movement between the collars 8, 9 are abated by flexure or elastic strain in the flexible connecting means without the airtight fit between the collars and the apertures in the panel 3 being affected.

Figure 2A:
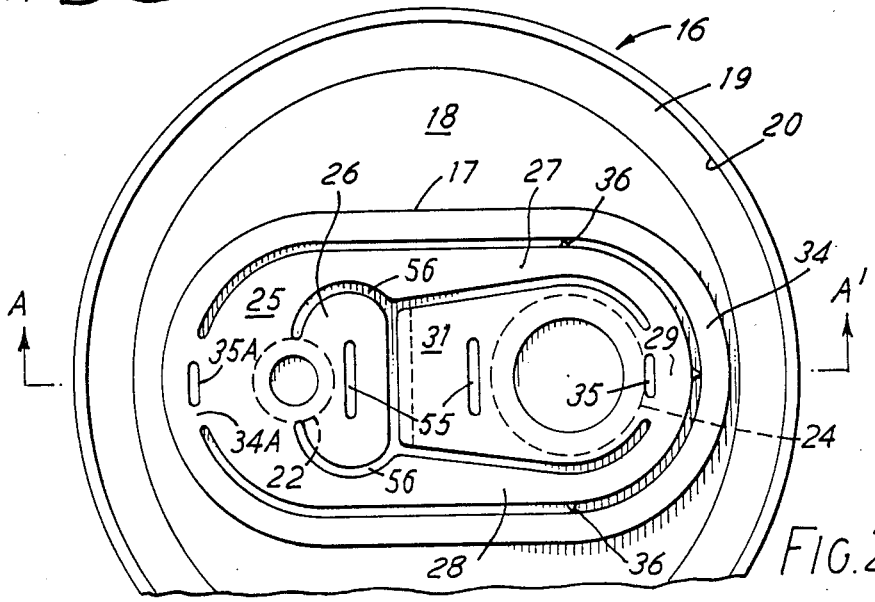
FIG. 2A is a plan view of a first embodiment of the closure fitted in a can end.
Figure 2B:
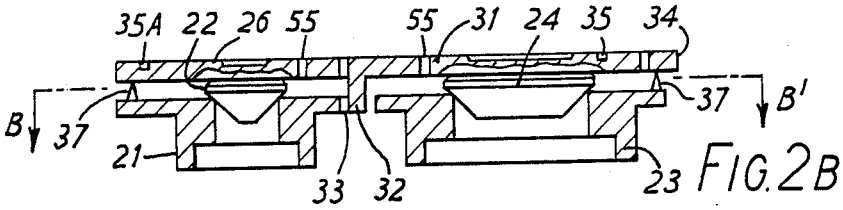
FIG. 2B is a section through the closure of FIG. 2A on the line denoted A—A'.
Figure 2C:
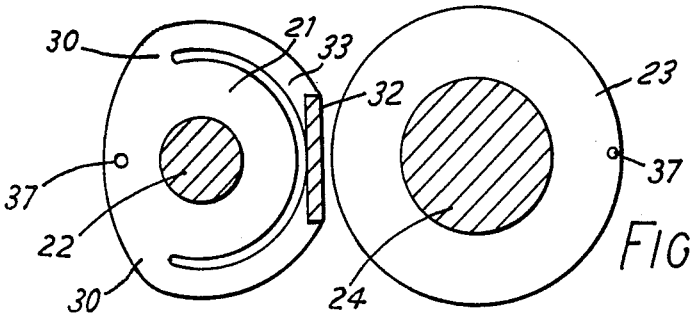
FIG. 2C is a sectional plan view on line B—B' in FIG. 2B.

Referring to FIGS. 2A, 2B and 2C, the closure 17 is a one piece moulding of plastics material comprising a vent aperture collar portion 21 sealed by a vent plug 22 and a pouring aperture collar portion 23 sealed by a pouring aperture plug 24. A flexible connecting member 25 (best seen in FIG. 2A) connects the two plugs. The flexible connecting member 25 includes the top plate 26 of vent plug 22 and a pair of side members or straps 27, 28 which pass, one to each side of the pouring aperture plug 24, to join the pouring aperture plug at a common junction 29. Arcuate slots 56 separate the straps 27,28 from the top plate 26 of the vent plug 22 except at its side remote from the pouring aperture plug 24. The connecting member 25 is flexible because it comprises thin plate and straps of plastics material so that any tilting of the axes of the collar portions and of the plugs which are sealed to them will simply bend the connecting member. The connecting member is able to permit lateral relative movement between the collar portions 21, 23 because the side members or straps 27, 28 taper to a narrow curved plan form which permits extension or compression if necessary. The connecting member 25 further includes a top flange 31 on the pouring aperture plug 24 through which it is flexibly connected to the vent aperture collar portion 21. The flexible connection comprises a step piece 32 extending from the plane of flange 31 to an arcuate yoke 33 which partially surrounds the collar portion 21. The yoke 33 joins step piece 32 to the collar portion 21 at two anchorage points 30 on opposite sides of the collar portion, as is best seen in FIG. 2C. In FIGS. 2B and 2C it can be clearly seen that the collar portions 21, 23 are free to tilt or move as the connecting member 25 flexes or extends.

Figure 3:
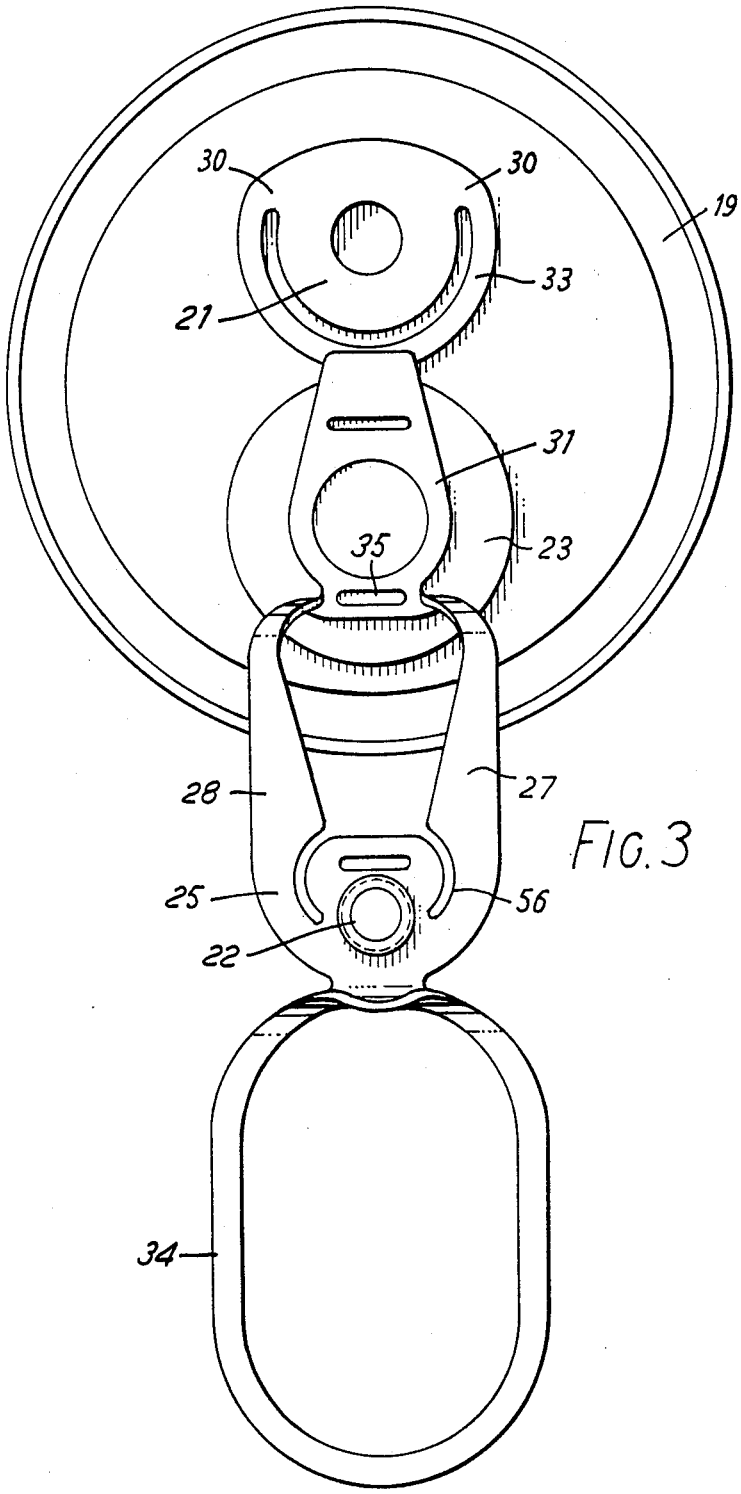
FIG. 3 is a plan view showing the first stage of opening of the closure of FIG. 2.

A pull ring 34 surrounds the plugs 22, 24 and is connected directly to the flexible connecting member 25 at 34A, so that lifting and pulling of the pull ring first tears the vent plug 22 away from the vent aperture collar portion 21 as is shown in FIG. 3.

In FIG. 3 the pull ring 34 has been pulled clear of the can end 19 so that the pull ring 34, the connecting member 25 with the vent plug 22, and the vent aperture collar portion 21 are clearly visible. In this first opened position the can has been vented so that the user, may if he wishes, drink by means of a straw. He may also reclose the can when he has had enough.

Referring again to FIG. 3 it will be seen that there is a small rectangular indent 35 between the extremities of side members 27, 28 where they join the top flange 31 of the pouring aperture plug 24. This small indent 35 encourages the plastics material to fold so that the pulling force delivered from pull ring 34 through side members 27, 28 is directed close to the edge of the pouring aperture plug 24, so avoiding any mechanical disadvantage arising from a more distant application of the tearing force. A like functioning indent 35A is provided where the pull ring 34 joins the connecting member 25.

Figure 4:
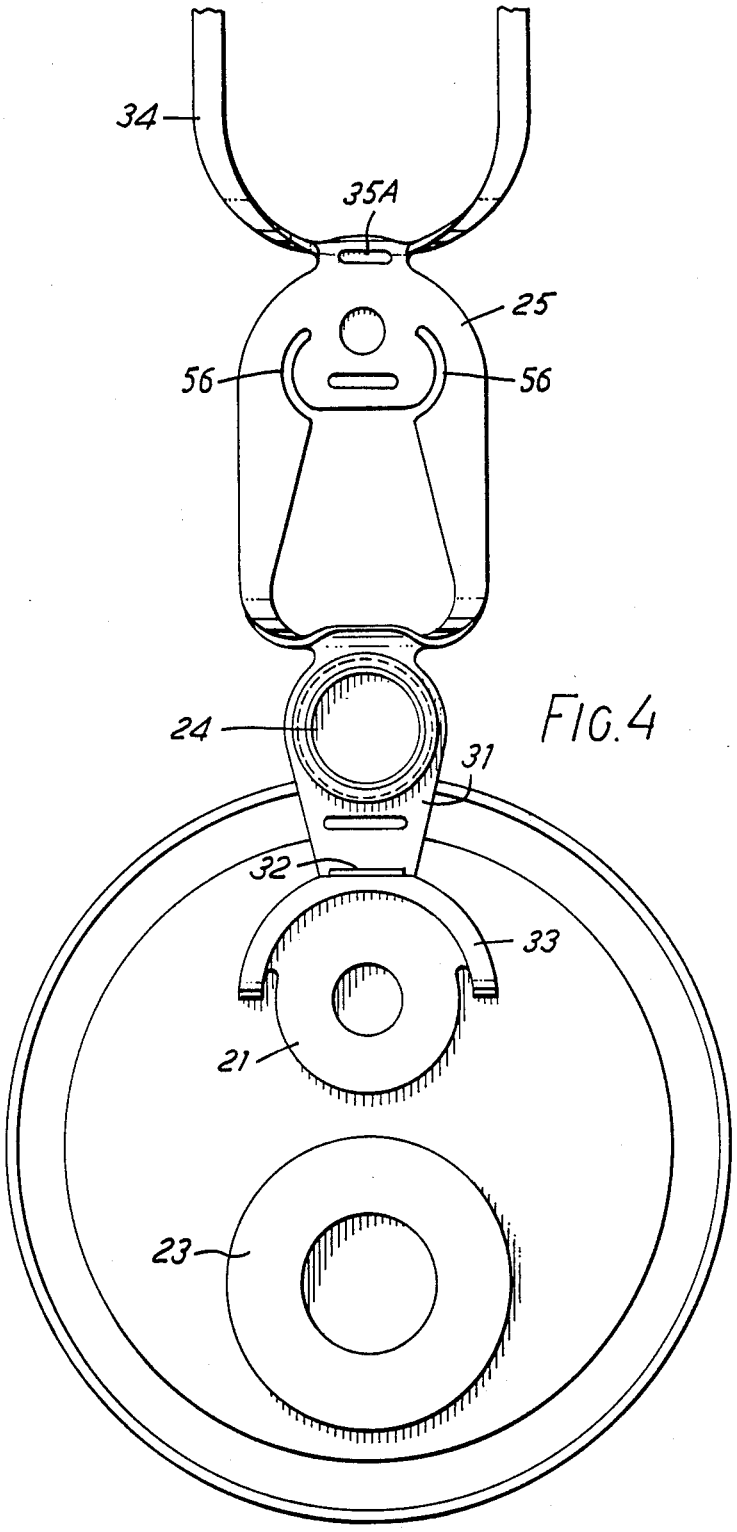
FIG. 4 is a plan view showing final stage of opening of the closure.

FIG. 4 shows the fully opened position in which both plugs 22, 24 have been torn away from their collar portions 21, 23 in readiness for pouring from the pouring aperture collar portion 23. The collar portion 23 can be seen to be separate from the collar portion 21. The captive closure members flexibly connected to the vent aperture collar portion 21 can be seen to comprise the yoke 33, the step piece 32, the flange 31, the pouring aperture plug 24, the flexible connecting member 25, the vent plug 22, and the pull ring 34.

The captive closure members may be refolded to reclose the apertures in the collar portions by snap fitting each plug 22, 24 into its respective collar portion 21, 23.

Rectangular slots 55 shown in FIGS. 2A and 2B provide access for rods used in the moulding process to hold down split plates used to mould the plug portions.

The pull ring 34 may, if desired, be held in position before use by means of rupturable side ties 36 (shown in FIG. 2A) in the form of rupturable filaments based on the connecting member 25. Such ties would provide visible evidence of tampering if broken. Alternatively filamentary ties 37 may extend from each collar portion to the underside of the pull ring as is shown in FIG. 2B. Whilst these ties 37 are less visible in use they may be easier to mould than ties 36.

Figure 5A:
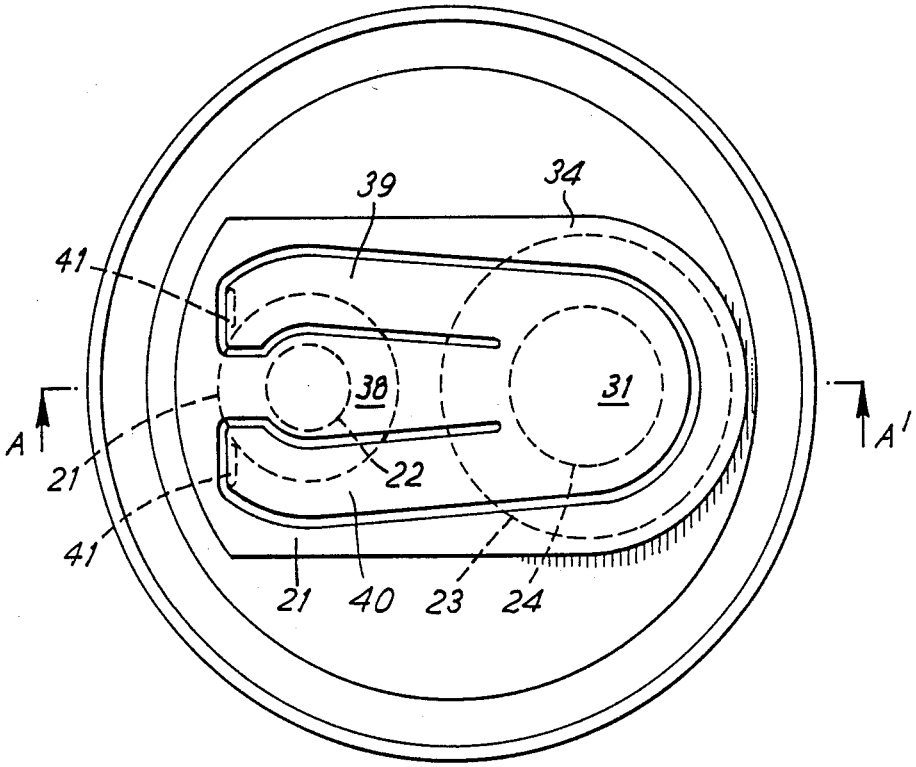
FIG. 5A is a plan view of a second embodiment of the closure fitted in a can end.
Figure 5B:
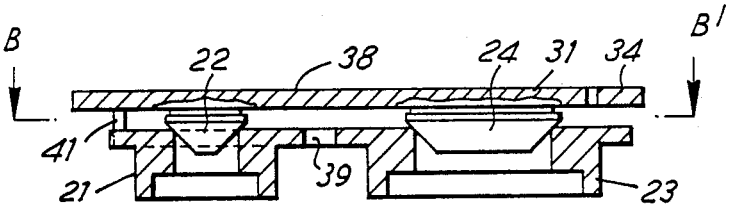
FIG. 5B is a section through the closure on line A—A' in FIG. 5A.
Figure 5C:
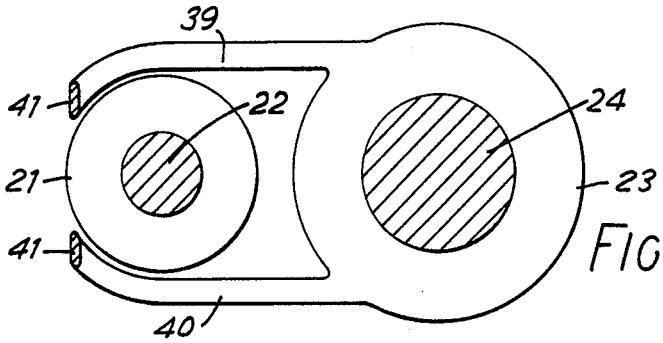
FIG. 5C is a sectional plan view taken on line B—B' in FIG. 5.

FIGS. 5A and 5B show a second embodiment of the closure in which the collar portions 21, 23 and plug portions 22, 24 are identical to those shown in FIGS. 2A, 2B and 2C. In contrast to FIG. 2A, the flexible connecting member 38 connects directly the pull ring 34, the vent plug 22 and pouring aperture plug 24. The connecting member 38 is flexible because it is of thin plastics material and extendable, if necessary, by virtue of its cross section. It is flexibly connected to the pouring aperture collar portion 23 by a pair of straps 39, 40, each strap extending from the top flange 31 of the plug 24 past one side of the vent plug 22 to a fold 41 and back past one side of the vent aperture collar portion 21 to join the pouring aperture collar portion 23, as shown in FIG. 5C.

Lifting and pulling on pull ring 34 first tears the vent plug 22 from its collar portion 21 and then tears the pouring aperture plug 24 from its collar portion 23. The straps 39, 40 are then unfolded at the fold 41 to leave both collars clear from pouring and venting.

Figure 6A:
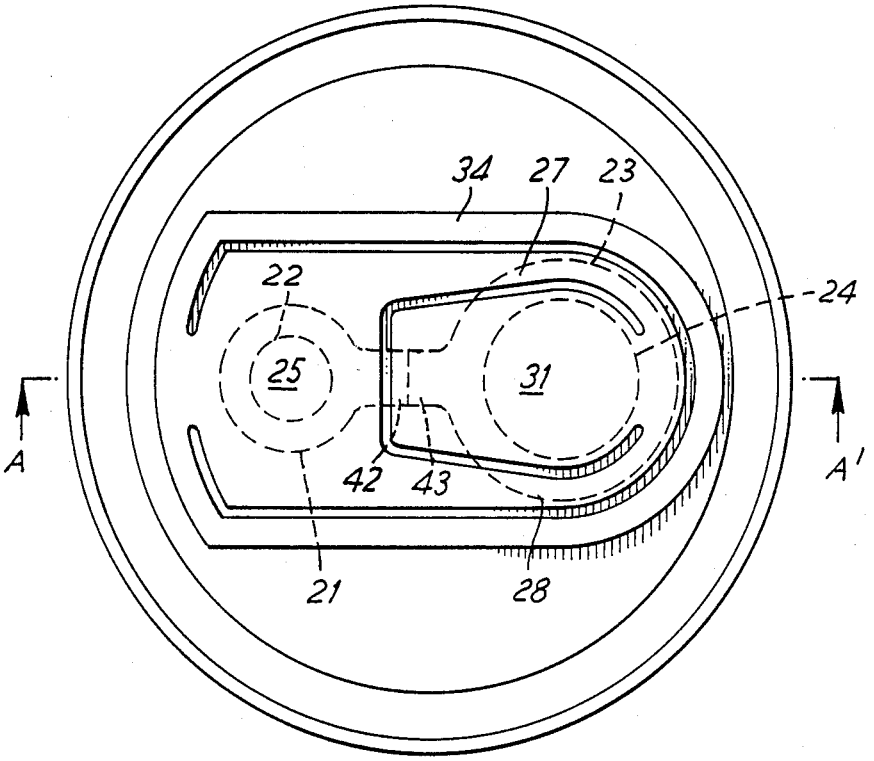
FIG. 6A is a plan view of a third embodiment of the closure fitted in a can end.
Figure 6B:
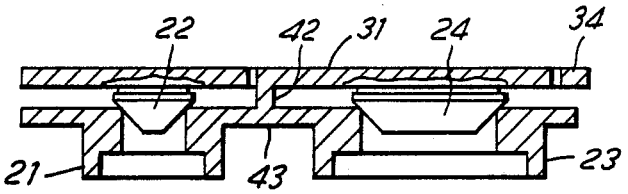
FIG. 6B is a section through the closure on line A—A' in FIG. 6A.

FIGS. 6A and 6B show a third embodiment of the closure in which the collar portions 21, 23 and plugs 22, 24 are as already described. In this embodiment the pull ring 34 connects with the flexible connecting member 25 which, as in FIG. 2, has side members or straps 27, 28 connecting with the top flange 31 of the pouring plug 24. However, in FIG. 6B the flexible connection of the connecting member 25 comprises an extension or step piece depending from one end of the top flange 31 and joining a narrow bridge 43 which joins the vent aperture collar portion 21 to the pouring aperture collar portion 23. The flexibility necessary to permit tilt of the collar axes is achieved by making the bridge 43 of a cross section and a plan form thin and slender enough so that extension or contraction of the side members 27, 28 of flexible connecting member 25 can be accommodated.

Figure 7A:
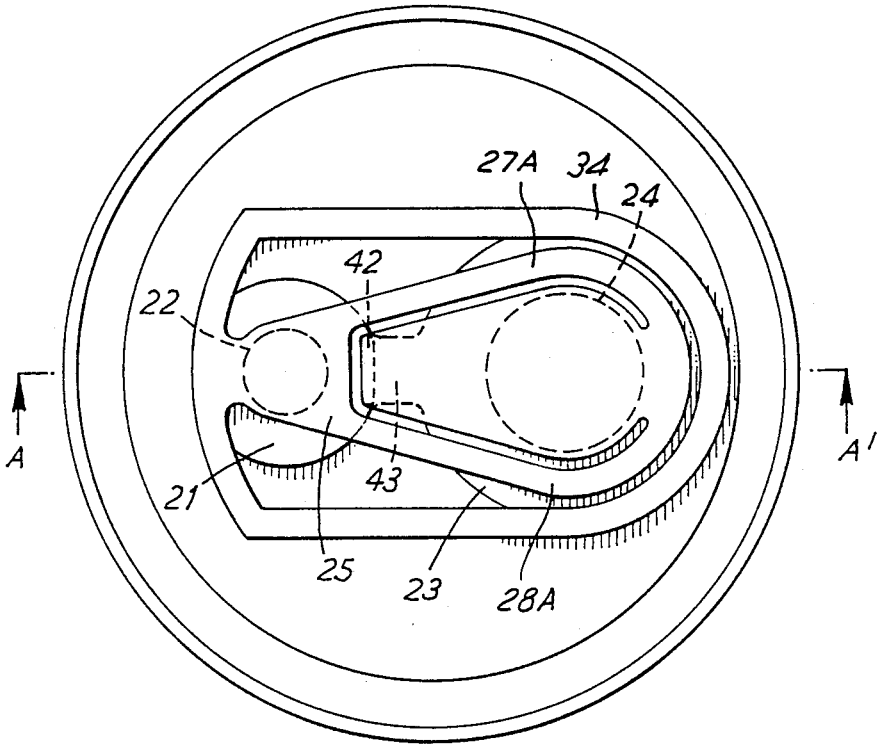
FIG. 7A is a plan view of a fourth embodiment of the closure fitted in a can end.
Figure 7B:
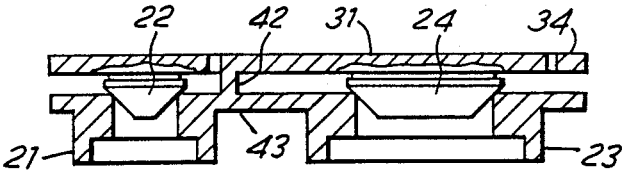
FIG. 7B is a section through the closure on line A—A' in FIG. 7A.

The fourth embodiment shown in FIGS. 7A and 7B is similar to that of FIGS. 6A and 6B, but the extendability of the flexible connecting member 25 is enhanced by making each side member 27A, 28A a narrow strap of a curved shape which can be extended or contracted by quite small forces. Like functioning parts to embodiments already described are indicated by like reference numbers.

Figure 8A:
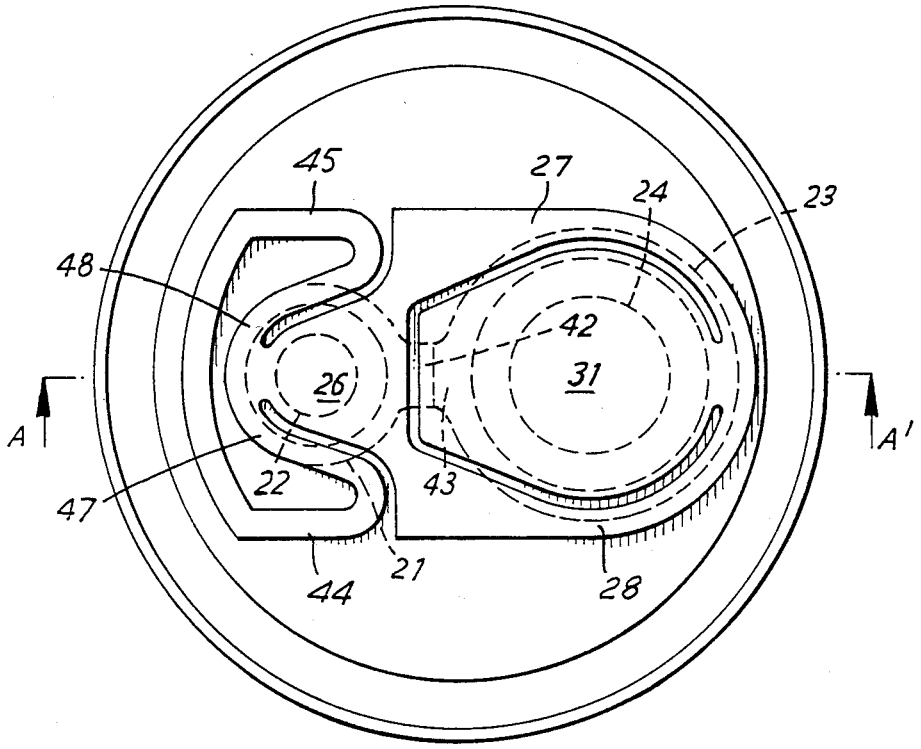
FIG. 8A is a plan view of a fifth embodiment of the closure fitted in a can end.
Figure 8B:
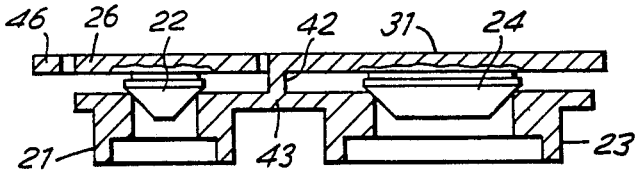
FIG. 8B is a section through the closure on line A—A' in FIG. 8A.

FIGS. 8A and 8B show another modified form of the embodiment of FIGS. 6A and 6B. In FIGS. 8A and 8B the pull ring no longer surrounds the closure, but comprises a pair of first curves 47, 48 extending one to each side of a common junction with the top plate 26 of the vent plug 22, each first curve 47, 48 connecting with a straight side piece 44, 45 aligned with the edges of side members 28, 27, the ends of the straight side pieces being joined by a second curve 46, to constitute a pull ring large enough to grip easily.

The parallel edges of this closure, as defined by the edges of side members 27, 28 and straight side pieces 44, 45, give suitable surfaces for guidance in automatic handling machinery. It will be noticed that all the embodiments described have a pair of parallel sides for this purpose, though the invention is not limited to such an arrangement. Whilst the preferred plastics materials for these closures is high density polyethylene or polypropylene, other plastics materials may be used.

In all the above embodiments, the freedom of the collar portions 21,23 to tilt relative to one another is such as to enable them to conform to the domed shape of a can end as shown in FIG. 1 without affecting the airtight fit between the collars and the respective apertures in the panel 3.

I claim:

1. A closure, for a container of the kind having a pouring aperture and a venting aperture in one end of the container, said closure being moulded in one piece of plastics material and comprising respective annular collar portions adapted to be fitted in an airtight manner within the said apertures, and respective plugs each attached by a rupturable section of the plastics material to the mouth of its annular collar portion to seal the respective aperture, each plug being shaped so that after breaking of the rupturable section to open the aperture the plug can be forced back into the collar portion to re-seal the aperture, the two plugs being connected to one another by a connecting member which is flexibly connected to one of the collar portions so as to retain the plugs after opening of the apertures, wherein the connections between each collar portion and the other parts of the closure are such as to ensure freedom of the collar portions to tilt relative to one another.

2. A closure according to claim 1 wherein the connections between each collar portion and the other parts of the closure consist solely of the rupturable attachments of the plugs and the flexible connection of the said one collar portion to the connecting member.

3. A closure according to claim 2 wherein the said flexible connection is provided by a flexible yoke attached to the said one collar portion and a step piece which joins the yoke to the connecting member.

4. A closure according to claim 2 wherein the connecting member comprises a pair of straps which connect remote sides of the two plugs together to allow relative tilting movement of the plugs.

5. A closure according to claim 1 wherein the said flexible connection comprises a pair of straps, each strap extending from the connecting member adjacent to the pouring aperture plug past one side of the vent plug to a fold and back past one side of the venting aperture collar portion to join the pouring aperture collar portion.

6. A closure according to claim 1 wherein the collar portions are attached to one another by a narrow flexible bridge and the connecting member comprises a pair of straps which connect one plug to the remote side of the other plug.

7. A closure according to claim 6 wherein the flexible connection of the said one collar portion to the connecting member is provided by a step piece joining the bridge to the connecting member.

8. A closure according to claim 1 wherein a ring pull is connected directly with the vent plug.

9. A closure according to claim 8 wherein the ring pull surrounds the vent plug and the pouring aperture plug before it is lifted to tear open the closure.

* * * * *